United States Patent [19]

Lemberger et al.

[11] Patent Number: 4,628,762

[45] Date of Patent: Dec. 16, 1986

[54] VALVE-ACTUATING LEVER FOR INTERNAL-COMBUSTION ENGINES

[75] Inventors: Heinz Lemberger, Unterföhring; Christoph Schausberger, Munich, both of Fed. Rep. of Germany

[73] Assignee: Bayerische Motoren Werke Aktiengesellschaft, Munich, Fed. Rep. of Germany

[21] Appl. No.: 474,596

[22] PCT Filed: Jun. 24, 1982

[86] PCT No.: PCT/EP82/00132

§ 371 Date: Feb. 25, 1983

§ 102(e) Date: Feb. 25, 1983

[87] PCT Pub. No.: WO83/00185

PCT Pub. Date: Jan. 20, 1983

[30] Foreign Application Priority Data

Jun. 27, 1981 [DE] Fed. Rep. of Germany ..... 3125362

[51] Int. Cl.[4] ..... G05G 1/10

[52] U.S. Cl. ..... 74/559; 74/519; 74/571 M; 123/90.42; 123/90.45

[58] Field of Search ..... 74/519, 559, 571 M; 123/90.45, 90.42, 90.39

[56] References Cited

U.S. PATENT DOCUMENTS

| | | | |
|---|---|---|---|
| 1,264,083 | 4/1918 | Jouffret | 123/90.45 X |
| 1,588,041 | 6/1926 | Moore | 123/90.42 |
| 1,950,590 | 3/1934 | Berry | 123/90.45 |
| 2,365,401 | 12/1944 | Fisk | 123/90.45 |
| 4,348,916 | 9/1982 | Shimano | 74/571 M X |
| 4,369,740 | 1/1983 | Seidl | 123/90.49 |

*Primary Examiner*—Harold W. Weakley
*Attorney, Agent, or Firm*—Barnes & Thornburg

[57] ABSTRACT

A rocker arm for a valve of a combustion engine comprising a lever arm with an offset end portion arranged in parallel to the longitudinal axis of the rocker arm. On a side face of said lever arm offset portion there is fixed an element for adjusting the valve clearance, oriented along the longitudinal axis of the rocker arm.

20 Claims, 7 Drawing Figures

FIG. 1
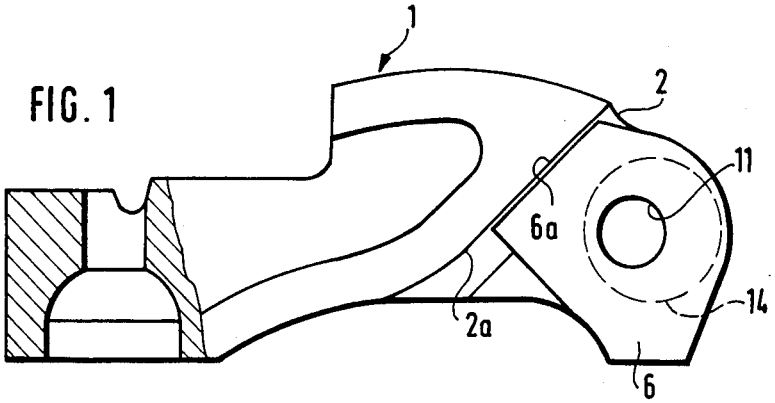
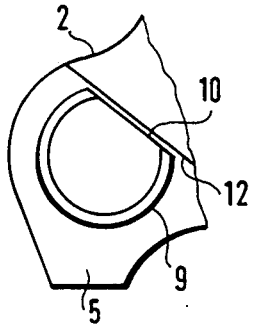
FIG. 2
FIG. 3
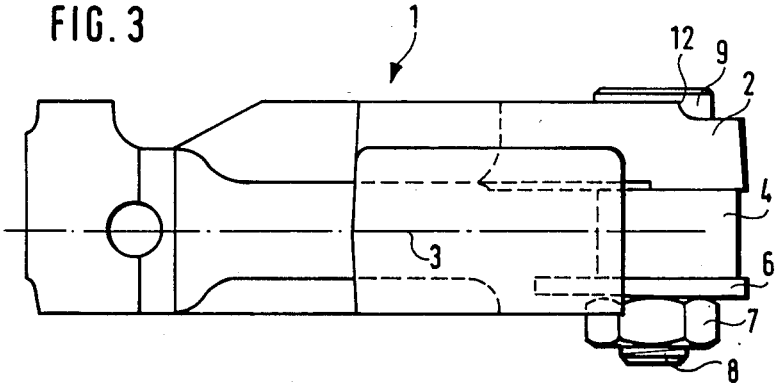

VALVE-ACTUATING LEVER FOR INTERNAL-COMBUSTION ENGINES

The invention concerns a valve-actuating lever for an internal combustion engine having a separate valve clearance adjusting element attached to the actuating lever at one end portion thereof and in alignment with the central longitudinal plane of the lever. The lever having the one end portion offset from its central longitudinal plane with the adjusting element being laterally attached thereto.

In the case of a known valve-actuating lever of this type (DE-Gm 1 908 833), a valve-clearance adjusting element is developed as an eccentric and is clamped between two arms at the forked end of the lever by means of a screw penetrating said arms and said valve-clearance adjusting element. In this case, the tolerances of the width of the eccentric and the distance between the arms must be very small in order to obtain a low clamping strain. As tests have shown, the extent of the clamping strain has considerable influence on the endurance limit of such valve-actuating levers. This endurance limit responds in a linear fashion with respect to the operating strain. To maintain a narrow eccentric clearance tolerance, in the case of large quantitities to be manufactured, is very expensive and costly. In addition, problems occur during the assembly due to the difficulty in fitting the eccentric between the two arms, since an automatic sliding-in of the eccentrics, between the arms, is almost impossible.

The invention is based on the objective to create a valve-actuating lever for an internal combustion engine having a separate valve clearance adjusting element attached to the actuating lever at one end portion thereof and in alignment with the central longitudinal plane of the lever. The lever having the one end portion offset from its central longitudinal plane with the adjusting element being laterally attached thereto. Since no forked end of the lever is used, clamping of the valve-clearance adjusting element can cause no strain through a deformation of a fork formed at the end of the lever and. Additionally, no narrow manufacturing tolerances in regard to the thickness of the valve-clearance adjusting element must be maintained. This eliminates tolerance production problems and permits of an easy assembly. Without the prior art strain a high endurance life for the actuator is obtained.

The invention achieves this objective by having a valve adjusting element attached to the actuating lever at one end portion thereof and in alignment with the central longitudinal plane of the lever. The lever having one end portion offset from its central longitudinal plane with the adjusting element being laterally attached thereto. While it is true that the one-sided fastening of the valve-clearance adjusting element creates torsional strain within the valve-actuating lever, this strain can be handled much more easily and will have a considerably smaller influence on the endurance limit of the lever than the clamping strain occurring in the known fork ended valve-actuating levers. Having the offset portion of the lever being parallel to the central longitudinal plane of the lever results in an especially useful embodiment. Locating a dependent projection on the offset arm cooperating with a similar dependent projection on plate, which is located on the opposite side of the element from the arm, provides a simple and an advantageous lateral guidance for the valve-actuating lever with the end of a valve stem which is especially useful in the case of a where the actuating lever is used as a drag lever. In such an installation, an edge of the plate adjacent a straight edge of the lever is complimentary straight therewith, so as to prohibit rotation of the plate.

An eccentric actuating element is non-rotatably mounted on a rod angularly secured to the offset by means of a screw bolt, or a fillister socket head in the element itself, and at one end of the rod and with a screw nut on the other end. Adjustment of the screw bolt or socket head permits an easy angular adjustment of the valve clearance by means of only two monkey wrenches or similar tools. When the lever is made of light metal, use of a U-shaped guard plate, surrounding the upper and side portions of the element, prevent a sinking-in of the valve-clearance adjusting element into the material of the valve-actuating lever. In addition, this U-shaped guard plate prevents a transfer of a twist-off momentum from the eccentrically developed valve-clearance adjusting element to the nut holding the element on its rod.

These and other objects, features, and advantages of the present invention will become more apparent from the following description when taken in connection with the accompanying drawings which show, for the purposes of illustration only, plural embodiments in accordance with the present invention, and wherein:

FIG. 1 shows a lateral view of a valve-actuating lever for internal-combustion engines developed as a drag lever, where the screwed connection for the fastening of the valve-clearance adjusting element was left out;

FIG. 2 shows a lateral view of the end of the drag lever of FIG. 1 from the opposite side as shown at the top of FIG. 3;

FIG. 3 shows a plan view of the drag lever shown in FIG. 1;

Figure 4:
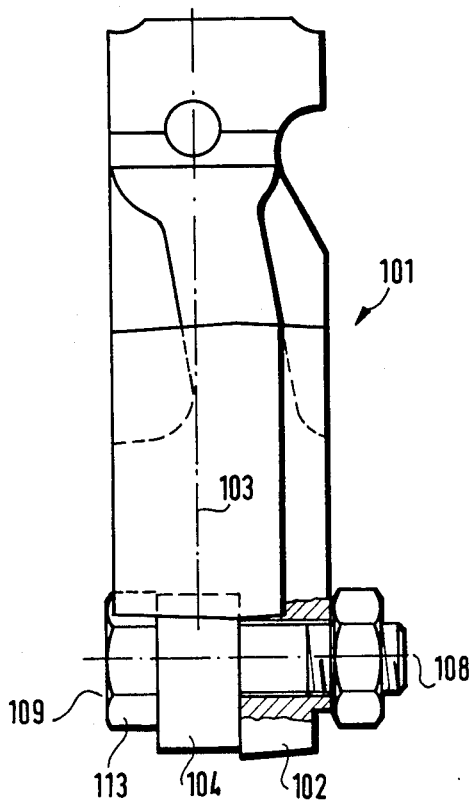
FIG. 4 shows a plan view of another element attaching embodiment of a drag lever.
Figure 5:
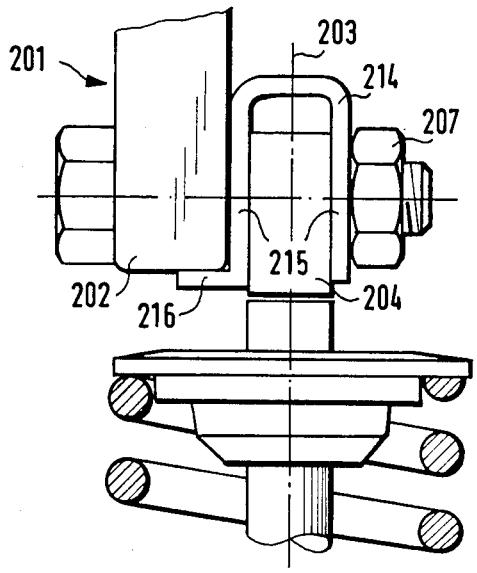
FIG. 5 is a front view of the end of another embodiment a drag lever utilizing a U-shaped guard and its arrangement with respect to an end of the valve shaft.
Figure 6:
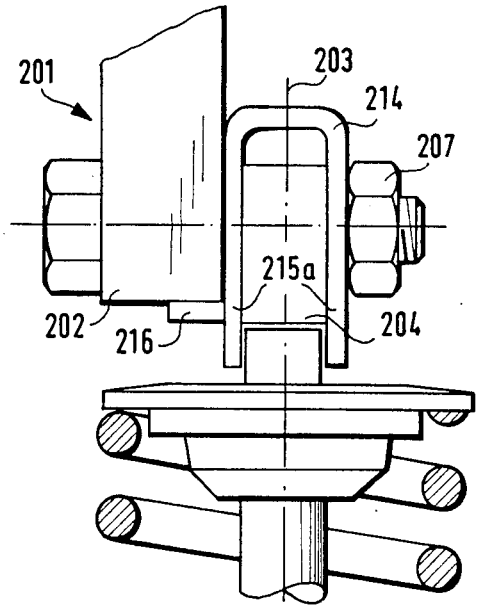
FIG. 6 shows another embodiment of the U-shaped guard shown in a fashion that is similar to FIG. 5.
Figure 7:
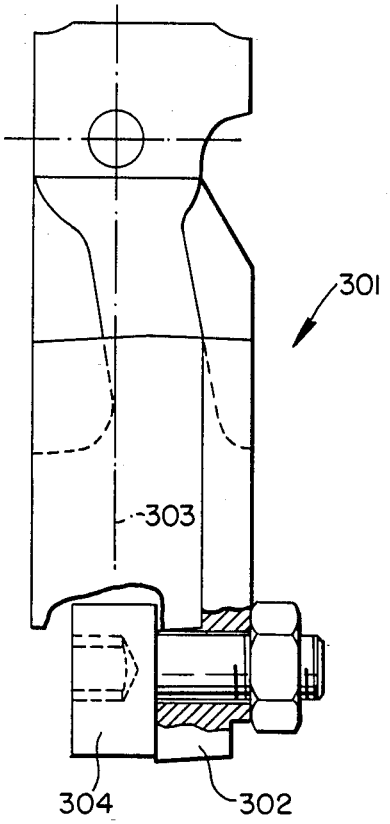
FIG. 7 shows an embodiment similar to FIG. 4 where a fillister head screw is located internally of the actuating element.

Referring now to the drawings wherein like reference numerals are used to designate like parts with the species of FIGS. 4 and 6 prefixing the numerals with a one hundred designation, FIGS. 5 and 6 utillizing a two hundred prefix and FIG. 7 using a three hundred prefix and more particularly to FIG. 1 wherein a valve-actuating lever 1 for internal-combustion engines is shown as a drag lever. Lever end 2 actuates a valve that is not shown and is shaped asymmetrically so that the lever end 2 is arranged outside the central longitudinal plane 3 of the valve-actuating lever 1 and is displaced in parallel to said central longitudinal plane 3. At the side that faces said central longitudinal plane 3, a valve-clearance adjusting element 4 is fastened in the form of an eccentric (see hidden configuration 14), the center of which is disposed in the central longitudinal plane 3. The valve-clearance adjusting element 4 is tensionally fastened at the end 2 of the lever by means of a screwed connection.

A dependent flap 5 (see FIG. 2) is developed on the bottom end 2 of the lever that is disposed on the one side. Said flap 5, in the case of an installed valve-actuating lever, rests laterally against the end of the valve shaft that is not shown. A small plate 6 rests against the opposite side of the end of the valve shaft, with said small plate 6 being arranged between the valve-clearance adjusting element 4 and a nut 7 on the screw bolt 8 holding said valve-clearance adjusting element 4, and with a straight edge 6*a*, in order to guard against resting against a plane sloping area 2*a* of the valve-actuating lever 1 to guard against twisting of the plate relative to arm 1. A segmentally shaped piece is cut off the circular head 9 of the screw bolt 8 with the resulting edge 10 of the cut off resting against an edge 12 cut in the one-sided end 2 of the lever at a corresponding distance from the borehole 11. These cooperating edges secure head 9 against twisting. During the adjustment of the valve-clearance, only two tools must be used in each case; namely, a tool for turning the valve-clearance adjusting element 4 developed as an eccentric and a tool for the loosening and tightening of the nut 7.

In the case of the embodiment shown in FIG. 4, the valve-clearance adjusting element 104 is tightly connected with a hexagon 113, in which case the valve-clearance element 104 and the hexagon 113 are either provided with an internal thread or are developed as the head of a screw, and are thus fastened by means of a hexagon cap screw or a hexagonal nut at the one-sided end 102 of the lever. In the case of a modified embodiment shown in FIG. 7, the actuating element 304, which is disposed eccentrically to the shaft, is in the form of a fillister socket head screw which can be rotated to angularly adjust the valve-clearance adjusting element with respect to the offset end portion 302 of valve actuating arm 301.

In the case of the embodiments shown in FIGS. 5 and 6, a guard plate 214 is fastened at the end 202 of the lever, which, plate is to prevent a pressing of the valve-clearance adjusting element 204 into the material at the end 202 of the lever, when the valve-actuating lever 201 is made of a softer material than the valve-clearance adjusting element 204. The guard plate 214 is developed in U-shape so that the valve-clearance adjusting element 204 is disposed between its two arms 215 in order to avoid a transfer of the twisting moment exercised on the nut 207, during tightening or loosening, to the valve-clearance adjusting element 204. In order to secure the guard plate 214 against twisting, a flap 216 is bent at the end of one arm 215. Said flap 216 rests against the end 202 of the lever. In the case of the embodiment shown in FIG. 6, the arms 215*a* of the U-shaped guard plate 214 project beyond the valve-clearance adjusting element 204 and are used for the lateral guidance of the valve-actuating lever at the end of the valve stem.

By means of the one-sided development of the lever ends 2; 102; 202 and the corresponding one-sided arrangement of the eccentrics used as valve-clearance adjusting elements 4; 104; 204 in the area of the central longitudinal plane 3; 103; 203 of the valve-actuating lever 1; 101; 201, a considerable improvement in regard to manufacturing tolerances and assembly of the valve-actuating lever 1; 101; 201 as well as high durability are achieved, while maintaining a symmetrical bearing load of the valve-actuating lever 1; 101; 201.

While we have shown and described plural embodiments in accordance with the present invention, it is understood that the same is not limited thereto but is susceptible to numerous changes and modifications as known to one having ordinary skill in the art and we therefore do not wish to be limited to the details shown and described herein, but intend to cover all such modifications as are encompassed by the scope of the appended claims.

We claim:

1. An elongated valve actuating lever having a central longitudinal axis along its length and a single end portion, the end portion of the valve actuating lever being offset to one side of said longitudinal axis and having a first side surface which is offset and in parallel with said longitudinal axis and displaced to the side thereof; a valve-clearance actuating element having an actuating surface portion for actuating a valve; said actuating surface portion being centrally aligned with said longitudinal central axis of the actuating lever; said actuating element being positioned adjacent the offset parallel side surface of the end portion; and means for cantileverly attaching the actuating element to said end portion adjacent the said one side surface.

2. A valve actuating lever according to claim 1, wherein the actuating element surface portion is of an eccentric form with respect to a central axis of the attachment means and wherein the attachment means can be rotated about said central axis to adjust valve-clearance.

3. A valve actuating lever according to claim 2, wherein the adjusting element has a wrench engaging profile surface associated therewith and wherein said profile surface is utilized to rotate the attachment means.

4. A valve actuating lever according to claim 3, wherein the wrench engaging profile surface is a fillister located at a side of the actuating element, not adjacent to the first side surface of the offset end portion of the lever and wherein said fillister is in axial alignment with the central rotation axis of the attachment means.

5. A valve actuating lever according to claim 3, wherein the wrench engaging profile surface is on a screw nut portion of the attachment means, located at a side of the actuating element, not adjacent to the first side surface of the offset end portion of the lever and wherein said screw nut portion is in axial alignment with the central rotation axis of the attachment means.

6. A valve actuating element according to claim 5, with the attachment means including a screw head portion in alignment with the central rotation axis and connected to the screw nut portion and wherein the screw head portion is located adjacent to the offset end portion of the lever at a second side surface thereof, which second side portion is more offset from the central longitudinal axis than the first side surface.

7. A valve actuating element according to claim 5, with the attachment means including a screw head portion in alignment with the central rotation axis and connected to the screw nut portion.

8. A valve actuating element according to claim 6, wherein said screw head portion has an edge portion thereon which cooperates with a corresponding edge portion on the lever arm to prevent rotation of the attachment means when said two edge portions abut one another.

9. A valve actuating element according to claim 7, wherein said screw head portion has an edge portion thereon which cooperates with a corresponding edge portion on the lever arm to prevent rotation of the attachment means when said two edge portions abut one another.

10. A valve actuating lever according to claim 1, wherein the offset end portion of the valve actuating lever has a dependent flap portion projecting beyond the actuating element surface portion into a slidable contact with one side of a valve stem for lateral guidance of the actuating lever and wherein a small plate is disposed in a non-rotatable, non-twistable orientation adjacent the actuating element on a side thereof away from the offset end portion of the lever and into a slidable contact with another side of the valve stem, and wherein the slidable contact of the valve stem with the dependent flap portion of the offset end portion and with the small plate acts as a lateral guidance for the valve actuating lever.

11. A valve actuating lever according to claim 2, wherein the offset end portion of the valve actuating lever has a dependent flap portion projecting beyond the actuating element surface portion into a slidable contact with one side of a valve stem for lateral guidance of the actuating lever and wherein a small plate is disposed in a non-rotatable, non-twistable orientation adjacent the actuating element on a side thereof away from the offset end portion of the lever and into a slidable contact with another side of the valve stem, and wherein the slidable contact of the valve stem with the dependent flap portion of the offset end portion and with the small plate acts as a lateral guidance for the valve actuating lever.

12. A valve actuating lever according to claim 1, wherein a guard plate means is attached to the valve actuating lever with a portion thereof located between the valve actuating element and the valve actuating lever for preventing pressuring of the valve adjusting element into the valve actuating lever.

13. A valve actuating lever according to claim 2, wherein a guard plate means is attached to the valve actuating lever with a portion thereof located between the valve actuating element and the valve actuating lever for preventing pressuring of the valve adjusting element into the valve actuating lever.

14. A valve actuating lever according to claim 3, wherein a guard plate means is attached to the valve actuating lever with a portion thereof located between the valve actuating element and the valve actuating lever for preventing pressuring of the valve adjusting element into the valve actuating lever.

15. A valve actuating lever according to claim 4, wherein a guard plate means is attached to the valve actuating lever with a portion thereof located between the valve actuating element and the valve actuating lever for preventing pressuring of the valve adjusting element into the valve actuating lever.

16. A valve actuating lever according to claim 5, wherein a guard plate means is attached to the valve actuating lever with a portion thereof located between the valve actuating element and the valve actuating lever for preventing pressuring of the valve adjusting element into the valve actuating lever.

17. A valve actuating lever according to claim 12, wherein the guard means is of a generally U-shaped configuration with the legs of the U-shape hanging below the actuating surface of the valve actuating element into sliding contact with slides of a valve stem to provide for lateral guidance of the actuating lever.

18. A valve actuating lever according to claim 14, wherein the guard means is of a generally U-shaped configuration with the legs of the U-shape hanging below the actuating surface of the valve actuating element into sliding contact with slides of a valve stem to provide for lateral guidance of the actuating lever.

19. A valve actuating lever according to claim 15, wherein the guard means is of a generally U-shaped configuration with the legs of the U-shape hanging below the actuating surface of the valve actuating element into sliding contact with slides of a valve stem to provide for lateral guidance of the actuating lever.

20. A valve actuating lever according to claim 16, wherein the guard means is of a generally U-shaped configuration with the legs of the U-shape hanging below the actuating surface of the valve actuating element into sliding contact with slides of a valve stem to provide for lateral guidance of the actuating lever.

* * * * *